US008450253B2

(12) United States Patent
Komatsubara

(10) Patent No.: US 8,450,253 B2
(45) Date of Patent: May 28, 2013

(54) LUBRICATING OIL COMPOSITION

(75) Inventor: Hitoshi Komatsubara, Yokohama (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 298 days.

(21) Appl. No.: 12/936,418

(22) PCT Filed: Mar. 30, 2009

(86) PCT No.: PCT/JP2009/001457

§ 371 (c)(1),
(2), (4) Date: Oct. 5, 2010

(87) PCT Pub. No.: WO2009/125551

PCT Pub. Date: Oct. 15, 2009

(65) Prior Publication Data

US 2011/0034358 A1 Feb. 10, 2011

(30) Foreign Application Priority Data

Apr. 7, 2008 (JP) ..... 2008-099105

(51) Int. Cl.
*C10M 111/02* (2006.01)
*C10M 145/14* (2006.01)

(52) U.S. Cl.
USPC ..... 508/110; 508/469

(58) Field of Classification Search
USPC ..... 508/110, 459, 469
See application file for complete search history.

(56) References Cited

U.S. PATENT DOCUMENTS

| | | | | |
|---|---|---|---|---|
| 4,263,152 | A | 4/1981 | King et al. | |
| 5,064,546 | A | 11/1991 | Dasai | |
| 5,354,484 | A | 10/1994 | Schwind et al. | |
| 5,552,068 | A | 9/1996 | Griffith | |
| 5,595,964 | A | 1/1997 | Bardasz | |
| 5,744,430 | A | 4/1998 | Inoue et al. | |
| 5,792,731 | A | 8/1998 | Ichihashi et al. | |
| 6,001,780 | A | 12/1999 | Ho et al. | |
| 6,114,288 | A | 9/2000 | Fujitsu et al. | |
| 6,303,546 | B1 | 10/2001 | Hata et al. | |
| 6,306,801 | B1 | 10/2001 | Yagishita et al. | |
| 6,323,162 | B1 | 11/2001 | Yasunori et al. | |
| 6,569,818 | B2 | 5/2003 | Nakazato et al. | |
| 6,569,819 | B2 | 5/2003 | Yagishita et al. | |
| 6,617,286 | B2 | 9/2003 | Sato et al. | |
| 6,638,897 | B2 | 10/2003 | Ogano et al. | |
| 6,720,293 | B2 | 4/2004 | Bovington et al. | |
| 6,756,346 | B1 | 6/2004 | Baba et al. | |
| 6,815,401 | B2 | 11/2004 | Nakamura | |
| 2001/0004389 | A1 | 6/2001 | Kimura et al. | |
| 2001/0007851 | A1 * | 7/2001 | Gao | 508/469 |
| 2002/0002120 | A1 | 1/2002 | Gahagan | |
| 2002/0142922 | A1 | 10/2002 | Yagishita et al. | |
| 2004/0110647 | A1 | 6/2004 | Gapinski | |
| 2004/0176260 | A1 | 9/2004 | Shirahama et al. | |
| 2005/0261147 | A1 | 11/2005 | Rosenbaum et al. | |
| 2006/0100467 | A1 | 5/2006 | Holmes et al. | |
| 2006/0111255 | A1 | 5/2006 | Shirahama et al. | |
| 2006/0131210 | A1 | 6/2006 | Rosenbaum et al. | |
| 2006/0135378 | A1 | 6/2006 | Takahashi et al. | |
| 2006/0172898 | A1 | 8/2006 | Roby et al. | |
| 2006/0201852 | A1 | 9/2006 | Rosenbaum et al. | |
| 2007/0287643 | A1 | 12/2007 | Matsui et al. | |
| 2008/0026967 | A1 | 1/2008 | Suda et al. | |
| 2008/0110799 | A1 | 5/2008 | Matsui et al. | |
| 2011/0034358 | A1 | 2/2011 | Komatsubara | |

FOREIGN PATENT DOCUMENTS

| | | | |
|---|---|---|---|
| EP | 0281992 | A2 | 9/1988 |
| EP | 0 686 689 | A2 | 12/1995 |
| EP | 1741771 | A1 | 1/2007 |
| JP | 5610591 | A | 2/1981 |
| JP | 63223094 | A | 9/1988 |
| JP | 04036391 | A | 2/1992 |
| JP | 8302378 | A | 11/1996 |
| JP | 93463 | A | 1/1997 |
| JP | 11-293266 | A | 10/1999 |
| JP | 11286696 | A | 10/1999 |
| JP | 2000-001682 | A | 1/2000 |
| JP | 2000256690 | A | 9/2000 |
| JP | 2000319682 | A | 11/2000 |
| JP | 2001164283 | A | 6/2001 |
| JP | 2001279287 | A | 10/2001 |

(Continued)

OTHER PUBLICATIONS

Office Action dated Dec. 2, 2009 in U.S. Appl. No. 11/757,109.
Office Action dated May 27, 2009 in U.S. Appl. No. 11/757,109.
Office Action dated Jan. 14, 2009 in U.S. Appl. No. 10/800,949.
Office Action dated May 2, 2008 in U.S. Appl. No. 10/800,949.
Office Action dated Oct. 31, 2007 in U.S. Appl. No. 10/800,949.
Office Action dated Apr. 3, 2007 in U.S. App. No. 10/800,949.
Office Action dated Dec. 1, 2009 in U.S. Appl. No. 11/933,834.

(Continued)

*Primary Examiner* — Jim Goloboy

(74) *Attorney, Agent, or Firm* — Panitch Schwarze Belisario & Nadel LLP

(57) ABSTRACT

The present invention provides a lubricating oil composition that is excellent in anti-fatigue properties for metals and load bearing properties while having improved fuel efficiency. The lubricating oil composition comprises (A) one type or a mixture of two or more types of mineral base oil having a 40° C. kinematic viscosity of from 5 to 15 $mm^2/s$; and (B) one type or a mixture of two or more types of ester-based base oil having a 40° C. kinematic viscosity of from 3 to 25 $mm^2/s$ and a 0° C. kinematic viscosity of from 10 to 130 $mm^2/s$, the 40° C. kinematic viscosity of the mixed base oil of (A) and (B) being 18 $mm^2/s$ or lower, the blend ratio of the ester-based base oil being from 0.58 to 80 percent by mass, and the 40° C. kinematic viscosity of the composition being from 4 to 23 $mm^2/s$.

7 Claims, No Drawings

FOREIGN PATENT DOCUMENTS

| | | | |
|---|---|---|---|
| JP | 2002129182 | A | 5/2002 |
| JP | 2002-294271 | A | 10/2002 |
| JP | 2003-041283 | A | 2/2003 |
| JP | 2003-514099 | A | 4/2003 |
| JP | 2004010799 | A | 1/2004 |
| JP | 2004-262979 | A | 9/2004 |
| JP | 2004-277712 | A | 10/2004 |
| WO | 9826030 | A1 | 6/1998 |
| WO | 9931113 | A1 | 6/1999 |
| WO | 0134735 | A1 | 5/2001 |
| WO | 02070636 | A1 | 9/2002 |
| WO | 2004/069967 | A1 | 8/2004 |
| WO | 2005/095556 | A1 | 10/2005 |
| WO | 2007095392 | A2 | 8/2007 |

OTHER PUBLICATIONS

Office Action dated May 21, 2009 in U.S. Appl. No. 11/933,634.

Notice of Allowance issued Jun. 6, 2011 in U.S. Appl. No. 11/757,109.

Int'l Search Report issued on Jun. 9, 2009 in Int'l Application No. PCT/JP2009/001457.

Search Report issued Dec. 6, 2012 in EP Application No. 09730401.8.

* cited by examiner

LUBRICATING OIL COMPOSITION

CROSS-REFERENCE TO RELATED APPLICATION

This application is a section 371 of International Application No. PCT/JP2009/001457, filed Mar. 30, 2009, which was published in the Japanese language on Oct. 15, 2009 under International Publication No. WO 2009/125551 A1 and the disclosure of which is incorporated herein by reference.

TECHNICAL FIELD

The present invention relates to lubricating oil compositions, more specifically to those having excellent viscosity temperature characteristics and low temperature fluidity and excellent anti-fatigue properties and load bearing properties, in particular to those suitable for automatic transmissions and/or continuously variable transmissions as well as internal combustions engines.

BACKGROUND ART

Traditionally, lubricating oils for automatic transmissions, manual transmissions, and internal combustions engines have been required to be improved in various durabilities such as thermal oxidation stability, anti-wear properties and anti-fatigue properties, and viscosity temperature characteristics and low temperature viscosity characteristics for improving fuel efficiency, such as reduced low temperature viscosity and low temperature fluidity. In order to improve such characteristics and properties, a lubricating oil has been used, whose base oil is appropriately blended with various additives, such as anti-oxidants, detergent-dispersants, anti-wear agents, friction modifiers, seal swell agents, viscosity index improvers, anti-foaming agents, colorants, and the like.

Recent transmissions and engines have been demanded to be fuel efficient, small and light and be increased in power output. Transmissions have been sought to be improved in power transmission capability in connection with the increased power output of the engines with which the transmissions are used in combination. Therefore, lubricating oils to be used for such transmissions have been demanded to maintain high lubricity and to possess properties to prevent the wear or fatigue of the surfaces of bearings and gears while reduced in the product viscosity and base oil viscosity. Further, automatic transmissions and continuously variable transmissions are supposed to be used in a cold region of −10° C. or lower and are thus required to be further improved in low temperature performance so as to enhance the low temperature startability and improve the fuel efficiency at low temperatures. Generally, a technique is employed, wherein viscosity temperature characteristics are improved by reducing the base oil viscosity and increasing the amount of a viscosity index improver in order to improve fuel efficiency. However, a reduction in the base oil viscosity degrades anti-fatigue properties. Therefore, the development of a lubricating oil has been eagerly desired, which can achieve both good fuel efficiency and anti-wear properties or anti-fatigue properties at higher levels at the same time. An improvement in low temperature viscosity characteristics can be accomplished by reducing the base oil viscosity or the final product viscosity. However, it has been known that a reduction in the base oil viscosity degrades anti-wear properties and anti-fatigue properties. The development of a lubricating oil has been eagerly desired, which can achieve both low temperature viscosity characteristics and anti-wear properties or anti-fatigue properties.

Under these circumstances, it has been known to use a base oil with a good low temperature performance or a base oil with a high viscosity in combination or to blend a phosphorus- or sulfur-based extreme pressure additive in a suitable amount in order to improve fuel efficiency, low temperature viscosity characteristics and anti-fatigue properties (see, for example, patent documents 1 to 3 below).

However, the techniques disclosed in these patent documents are not sufficient to attain viscosity temperature characteristics, low temperature performance and anti-fatigue properties, and load bearing properties at the same time. Therefore, it has been demanded to develop a lubricating oil composition having all of these performances and characteristics but undergoing no problem in other performances.

Patent Document 1: Japanese Patent Laid-Open Publication No. 2004-262979

Patent Document 2: Japanese Patent Laid-Open Publication No. 11-286696

Patent Document 3: Japanese Patent Laid-Open Publication No. 2003-514099

DISCLOSURE OF INVENTION

Technical Problem

In view of the above-described circumstances, the present invention has an object to provide a lubricating oil composition that has excellent viscosity temperature characteristics and low temperature performance as well as excellent anti-fatigue properties and load bearing properties, particularly suitable for automatic transmissions and/or continuously variable transmissions.

Solution to Problem

As the result of the extensive researches and studies carried out by the inventors of the present invention, the present invention was accomplished on the basis of the finding that a lubricating oil composition comprising a specific base oil and specific additives were excellent in viscosity temperature characteristics and low temperature performance and was able to be improved in anti-wear properties and metal fatigue life.

That is, the present invention relates to a lubricating oil composition comprising:

(A) one type or a mixture of two or more types of mineral base oil having a 40° C. kinematic viscosity of from 5 to 15 $mm^2/s$; and (B) one type or a mixture of two or more types of ester-based base oil having a 40° C. kinematic viscosity of from 3 to 25 $mm^2/s$ and a 0° C. kinematic viscosity of from 10 to 130 $mm^2/s$, the 40° C. kinematic viscosity of the mixed base oil of (A) and (B) being 18 $mm^2/s$ or lower, the blend ratio of the ester-based base oil being from 0.58 to 80 percent by mass, and the 40° C. kinematic viscosity of the composition being from 4 to 23 $mm^2/s$.

The ester-based base oil (B) is preferably a monoester.

The viscosity index of the ester-based base oil is preferably 170 or greater.

Preferably, the lubricating oil composition of the present invention further comprises (C) a polymethacrylate viscosity index improver with a weight-average molecular weight of 70,000 or less.

The present invention also relates to a transmission oil composition comprising any of the above-mentioned lubricating oil compositions.

Advantageous Effects of Invention

The lubricating oil composition of the present invention has not only excellent viscosity temperature characteristics and low temperature performance but also excellent metal fatigue life and load bearing properties. Therefore, the lubricating oil composition is particularly suitable for the automatic transmissions and/or continuously variable transmissions of automobiles, construction machinery, and agricultural machinery. Further, the lubricating oil composition may be suitably used as a lubricating oil for the manual transmissions and differential gears of automobiles, construction machinery, and agricultural machinery. Other than these usages, the lubricating oil composition may be suitably used as a gear oil for industrial use, a lubricating oil for the gasoline engines, diesel engines, and gas engines of automobiles such as two- and four-wheeled vehicles, power generators, and ships, a turbine oil, and a compressor oil.

BEST MODE FOR CARRYING OUT THE INVENTION

The present invention will be described in detail below.

Component (A) of the lubricating oil composition of the present invention is one type of or a mixture of two or more types of mineral base oil having a 40° C. kinematic viscosity of from 5 to 15 $mm^2/s$.

The 40° C. kinematic viscosity of Component (A) is necessarily from 5 to 15 $mm^2/s$, preferably 6 $mm^2/s$ or greater, more preferably 7 $mm^2/s$ or greater, more preferably 8 $mm^2/s$ or greater, particularly preferably 9 $mm^2/s$ or greater. The 40° C. kinematic viscosity is preferably 13 $mm^2/s$ or less, more preferably 12 $mm^2/s$ or less, more preferably 11 $mm^2/s$ or less, particularly preferably 10 $mm^2/s$ or less. When the 40° C. kinematic viscosity of Component (A) is greater than 15 $mm^2/s$, the resulting lubricating oil composition would be poor in viscosity temperature characteristics and low temperature viscosity characteristics. Meanwhile, when the 40° C. kinematic viscosity is less than 5 $mm^2/s$, the resulting lubricating oil composition would be poor in anti-fatigue properties for metals and load bearing properties due to its insufficient oil film formation at lubricating sites and would be large in evaporation loss of the lubricating base oil.

No particular limitation is imposed on the 100° C. kinematic viscosity of Component (A). However, the 100° C. kinematic viscosity is preferably from 1 to 5 $mm^2/s$, more preferably 1.5 $mm^2/s$ or greater, more preferably 2.0 $mm^2/s$ or greater, particularly preferably 2.3 $mm^2/s$ or greater, most preferably 2.5 $mm^2/s$ or greater. The 100° C. kinematic viscosity is preferably 4.0 $mm^2/s$ or less, more preferably 3.5 $mm^2/s$ or less, more preferably 3.3 $mm^2/s$ or less, particularly preferably 3.0 $mm^2/s$. When the 100° C. kinematic viscosity of Component (A) is greater than 5 $mm^2/s$, the resulting lubricating oil composition would be poor in viscosity temperature characteristics and low temperature viscosity characteristics. Meanwhile, when the 100° C. kinematic viscosity is less than 1 $mm^2/s$, the resulting lubricating oil composition would be poor in anti-fatigue properties for metals and load bearing properties due to its insufficient oil film formation at lubricating sites and would be large in evaporation loss of the lubricating base oil.

No particular limitation is imposed on the pour point of Component (A). However, the pour point is preferably −15° C. or lower, preferably −17.5° C. or lower, more preferably −20° C. or lower, particularly preferably −22.5° C. or lower, most preferably −25° C. or lower. No particular limitation is imposed on the lower limit of the pour point. However, the lower limit is preferably −45° C. or higher, more preferably −40° C. or higher, more preferably −35° C. or higher, particularly preferably −30° C. or higher in view of low temperature viscosity characteristics and economical efficiency of a dewaxing process. The use of Component (A) with a pour point of −15° C. or lower renders it possible to produce a lubricating oil composition with excellent low temperature viscosity characteristics. The dewaxing process may be either solvent dewaxing or catalytic dewaxing. However, the dewaxing process is preferably a catalytic dewaxing process because the low temperature viscosity characteristics can be further improved.

No particular limitation is imposed on the viscosity index of Component (A). However, the viscosity index is preferably 100 or greater, more preferably 105 or greater, more preferably 110 or greater. As one of the embodiments of the present invention, the viscosity index may be 135 or greater. However, the viscosity index is preferably 135 or less, more preferably 130 or less, more preferably 125 or less, particularly preferably 120 or less in view of more excellent solubility of additives and sludge. The use of Component (A) with a viscosity index of 100 or greater renders it possible to produce a lubricating oil composition with excellent viscosity temperature characteristics and low temperature viscosity characteristics.

No particular limitation is imposed on the % Cp of Component (A). However, the % Cp is preferably 70 or greater, more preferably 72 or greater, more preferably 73 or greater, particularly preferably 75 or greater with the objective of further enhancing thermal/oxidation stability and viscosity temperature characteristics. No particular limitation is imposed on the upper limit of the % Cp. As one of the embodiments of the present invention, the % $C_P$ may be 90 or greater. However, the % $C_P$ is preferably 90 or less, more preferably 85 or less in view of excellent solubility of additives and sludge.

No particular limitation is imposed on the % $C_A$ of Component (A). However, the % $C_A$ is preferably 5 or less, and with the objective of further enhancing thermal/oxidation stability and viscosity temperature characteristics more preferably 3 or less, more preferably 2 or less, particularly preferably 1 or less.

No particular limitation is imposed on the % $C_N$ of Component (A). However, the % $C_N$ is preferably 30 or less, more preferably 25 or less with the objective of further enhancing thermal/oxidation stability and viscosity temperature characteristics. No particular limitation is imposed on the lower limit of the % $C_N$. As one of the embodiments of the present invention, the % $C_N$ may be less than 10. However, the % $C_N$ is preferably 10 or greater, more preferably 15 or greater in view of excellent solubility of additives and sludge.

The % $C_A$, % $C_P$, and % $C_N$ used herein denote the percentages of the aromatic carbon number in the total carbon number, the paraffin carbon number in the total carbon number, and the naphthene carbon number in the total carbon number, respectively, determined by a method (n-d-M ring analysis) in accordance with ASTM D 3238-85.

No particular limitation is imposed on the saturate content in Component (A). However, the saturate content is preferably 90 percent by mass or more, more preferably 94 percent by mass or more, more preferably 98 percent by mass or more, particularly preferably 99 percent by mass or more, with the objective of further enhancing thermal/oxidation stability and viscosity temperature characteristics.

No particular limitation is imposed on the aromatic content in Component (A). However, the aromatic content is preferably 10 percent by mass or less, more preferably 6 percent by mass or less, more preferably 2 percent by mass or less, particularly preferably 1 percent by mass or less, with the objective of further enhancing thermal/oxidation stability and viscosity-temperature characteristics.

The saturate and aromatic contents used herein denote the values (unit: percent by mass) measured in accordance with ASTM D 2007-93.

No particular limitation is imposed on the aniline point of Component (A). However, the aniline point is preferably 90° C. or higher, more preferably 95° C. or higher, more preferably 100° C. or higher, particularly preferably 103° C. or higher because a lubricating oil composition with excellent low temperature viscosity characteristics and fatigue life can be produced. No particular limitation is imposed on the upper limit of the aniline point. As one of the embodiments of the present invention, the aniline point may be 120° C. or higher. However, the aniline point is preferably 120° C. or lower, more preferably 115° C. or lower, more preferably 110° C. or lower in view of excellent solubility of additives and sludge and excellent compatibility with sealing materials.

No particular limitation is imposed on the sulfur content in Component (A). However, the sulfur content is preferably 0.1 percent by mass or less, more preferably 0.05 percent by mass or less, more preferably 0.01 percent by mass or less.

No particular limitation is imposed on the nitrogen content in Component (A). However, the nitrogen content is preferably 5 ppm by mass or less, more preferably 3 ppm by mass or less because a lubricating oil composition with more excellent thermal/oxidation stability can be produced.

No particular limitation is imposed on the NOACK evaporation loss of Component (A). However, the NOACK evaporation loss is preferably from 2 to 70 percent by mass, more preferably from 5 to 60 percent by mass, more preferably from 20 to 50 percent by mass, more preferably from 25 to 50 percent by mass. The NOACK evaporation loss used herein denotes the evaporation loss measured in accordance with ASTM D 5800-95.

Component (A) may comprise one type of mineral oil only or a mixture of two or more types of mineral oil.

No particular limitation is imposed on the method of producing Component (A) as long as the above-described properties are attained. However, specifically, preferable examples of the lubricating base oil used in the present invention include those produced by subjecting a feedstock selected from the following base oils (1) to (8) and/or a lubricating oil fraction recovered therefrom to a given refining process and recovering the lubricating oil fraction:

(1) a distillate oil produced by atmospheric distillation of a paraffin base crude oil and/or a mixed base crude oil;
(2) a whole vacuum gas oil (WVGO) produced by vacuum distillation of an atmospheric distillation bottom from a paraffin base crude oil and/or a mixed base crude oil;
(3) a wax produced by a lubricating oil dewaxing process (slack wax) and/or a synthetic wax produced by a gas to liquid (GTL) process (Fischer-Tropsch wax, GTL wax);
(4) one or a mixed oil of two or more oils selected from the base oils (1) to (3) above and/or a mild-hydrocracked oil of the mixed oil;
(5) a mixed oil of two or more oils selected from the base oils (1) to (4) above;
(6) a deasphalted oil (DAO) obtained by deasphalting the base oil of (1), (2) (3), (4) or (5);
(7) an oil produced by mild-hydrocracking (MHC) the base oil (6); and
(8) a mixed oil of two or more oils selected from the base oils (1) to (7).

Examples of the above-mentioned given refining process include hydro-refining processes such as hydrocracking and hydrofinishing, solvent refining such as furfural solvent extraction, dewaxing such as solvent dewaxing and catalytic dewaxing, clay refining with acid clay or active clay, and chemical (acid or alkali) treating such as sulfuric acid treating and sodium hydroxide treating. In the present invention, any one or more of these refining processes may be used. When two or more of these refining processes are used in combination, no particular limitation is imposed on the order thereof. Therefore, the refining processes may be carried out in any order.

The lubricating base oil used in the present invention is particularly preferably the following base oil (9) or (10) produced by subjecting a base oil selected from the above-described base oils (1) to (8) or a lubricating oil fraction recovered therefrom to a specific treatment:

(9) a hydrocracked mineral oil produced by hydrocracking a base oil selected from the base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation; or
(10) a hydroisomerized mineral oil produced by hydroisomerizing a base oil selected from the base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation.

Particularly preferably, the dewaxing treatment carried out upon production of the lubricating base oil (9) or (10) includes a catalytic dewaxing treatment with the objectives of further enhancing the thermal/oxidation stability, low temperature viscosity characteristics, and anti-fatigue properties of the resulting lubricating oil composition.

If necessary, a solvent refining process and/or a hydrofinishing process may be carried out upon production of the lubricating base oil (9) or (10).

No particular limitation is imposed on the catalyst used in the above-described hydrocracking and hydroisomerizing. However, the catalyst is preferably a hydrocracking catalyst comprising any one of complex oxides having cracking activity (for example, silica-alumina, alumina boria, or silica zirconia) or one or more types of such complex oxides bound with a binder, used as a support and a metal with hydrogenation capability (for example, one or more types of metals of Groups VIa and VIII of the periodic table) supported on the support, or a hydroisomerizing catalyst comprising a support containing zeolite (for example, ZSM-5, zeolite beta, or SAPO-11) and a metal with hydrogenation capability, containing at least one or more types of metals of Group VIII of the periodic table and supported on the support. The hydrocracking and hydroisomerizing catalysts may be laminated or mixed so as to be used in combination.

No particular limitation is imposed on the conditions under which the hydrocracking and hydroisomerizing are carried out. Preferably, the hydrogen partial pressure is from 0.1 to 20 MPa, the average reaction temperature is from 150 to 450° C., the LHSV is from 0.1 to 3.0 $hr^{-1}$, and the hydrogen/oil ratio is from 50 to 20000 scf/bbl.

The catalytic dewaxing is carried out by reacting a hydrocracked or hydroisomerized oil with hydrogen under conditions effective in reducing the pour point of the oil in the presence of a suitable dewaxing catalyst. The catalytic dewaxing renders it possible to produce two or more types of lubricating base oils by converting a part of the high boiling point substance in the hydrocracked/hydroisomerized product to a low boiling point substance, separating the low boiling point substance from the heavier base oil fraction, and distilling the base oil fraction. The separation of the low boiling point substance may be carried out before producing the intended lubricating base oil or during the distillation.

No particular limitation is imposed on the dewaxing catalyst as long as it can decrease the pour point of the hydrocracked/hydroisomerized oil. However, preferably the catalyst can produce the intended lubricating base oil from the hydrocracked/hydroisomerized oil at a high yield. Preferred examples of such a dewaxing catalyst include shape-selective molecular sieves, more specifically ferrierite, mordenite, ZSM-5, ZSM-11, ZSN-23, ZSM-35, ZSM-22 (also referred to as Theta-1 or TON), and silico-alumino-phosphates (SAPO). The molecular sieves are used in combination with preferably a catalytic metal component, more preferably a precious metal. Preferred combination include complexes of for example platinum and H-mordenite.

No particular limitation is imposed on the dewaxing conditions. However, preferably the temperature is from 200 to 500° C., and the hydrogen pressure is from 10 to 200 bar (1 MPa to 20 MPa). When a flow-through reactor is used, the $H_2$ treating rate is preferably from 0.1 to 10 kg/l/hr, and the LHSV is preferably from 0.1 to 10 $h^{-1}$, more preferably from 0.2 to 2.0 $h^{-1}$. The dewaxing is preferably carried out so that usually 40 percent by mass or less, preferably 30 percent by mass or less of a substance with an initial boiling point of 350 to 400° C., contained in the hydrocracked/hydroisomerized oil is converted to a substance with a boiling point lower than the initial boiling point.

In addition to Component (A), the lubricating oil composition of the present invention comprises Component (B) that is an ester-based base oil with a 40° C. kinematic viscosity of from 3 to 25 $mm^2/s$ and a 0° C. kinematic viscosity of from 10 to 130 $mm^2/s$.

The 40° C. kinematic viscosity of Component (B) is necessarily from 3 to 25 $mm^2/s$, preferably 4 $mm^2/s$ or greater, more preferably 5 $mm^2/s$ or greater, more preferably 6 $mm^2/s$ or greater, particularly preferably 7 $mm^2/s$ or greater, most preferably 8 $mm^2/s$ or greater. The upper limit is preferably 23 $mm^2/s$ or less, more preferably 20 $mm^2/s$ or less, more preferably 15 $mm^2/s$ or less, particularly preferably 12 $mm^2/s$ or less, most preferably 10 $mm^2/s$ or less. When the 40° C. kinematic viscosity of Component (B) is greater than 25 $mm^2/s$, the resulting lubricating oil composition would be poor in viscosity temperature characteristics and low temperature viscosity characteristics. Meanwhile, when the 40° C. kinematic viscosity is less than 3 $mm^2/s$, the resulting lubricating oil composition would be poor in anti-fatigue properties for metals and load bearing properties due to its insufficient oil film formation at lubricating sites and would be large in evaporation loss of the lubricating base oil.

The 0° C. kinematic viscosity of Component (B) is necessarily from 10 to 130 $mm^2/s$, preferably 15 $mm^2/s$ or greater, more preferably 20 $mm^2/s$ or greater, more preferably 25 $mm^2/s$ or greater, particularly preferably 27 $mm^2/s$ or greater, most preferably 29 $mm^2/s$ or greater. The upper limit of the 0° C. kinematic viscosity is preferably 120 $mm^2/s$ or less, more preferably 100 $mm^2/s$ or less, more preferably 80 $mm^2/s$ or less, particularly preferably 60 $mm^2/s$ or less, most preferably 40 $mm^2/s$ or less. When the 0° C. kinematic viscosity of Component (B) is greater than 130 $mm^2/s$, the resulting lubricating oil composition would be poor in viscosity temperature characteristics and low temperature viscosity characteristics. Meanwhile, when the 0° C. kinematic viscosity is less than 10 $mm^2/s$, the resulting lubricating oil composition would be poor in anti-fatigue properties for metals and load bearing properties due to its insufficient oil film formation at lubricating sites and would be large in evaporation loss of the lubricating base oil.

No particular limitation is imposed on the 100° C. kinematic viscosity of Component (B). However, the lower limit is preferably 1.0 $mm^2/s$ or greater, more preferably 1.5 $mm^2/s$ or greater, more preferably 2.0 $mm^2/s$ or greater, particularly preferably 2.3 or greater, most preferably 2.5 $mm^2/s$ or greater. The upper limit is preferably 10 $mm^2/s$ or less, more preferably 5 $mm^2/s$ or less, more preferably 4 $mm^2/s$ or less, particularly preferably 3.5 $mm^2/s$ or less, most preferably 3.0 $mm^2/s$ or less. When the 100° C. kinematic viscosity of Component (B) is greater than 10 $mm^2/s$, the resulting lubricating oil composition would be poor in viscosity temperature characteristics and low temperature viscosity characteristics. Meanwhile, when the 100° C. kinematic viscosity is less than 1.0 $mm^2/s$, the resulting lubricating oil composition would be poor in anti-fatigue properties for metals and load bearing properties due to its insufficient oil film formation at lubricating sites and would be large in evaporation loss of the lubricating base oil.

No particular limitation is imposed on the viscosity index of Component (B). However, the lower limit is preferably 100 or greater, more preferably 120 or greater, more preferably 140 or greater, particularly preferably 160 or greater, most preferably 170 or greater, particularly most preferably 180 or greater. As one of the embodiments of the present invention, the viscosity index may be 220 or greater. However, the viscosity index is preferably 220 or less, more preferably 210 or less, more preferably 200 or less, particularly preferably 190 or less in view of excellent solubility with Component (A). The use of Component (B) with a viscosity index of 100 or greater renders it possible to produce a lubricating oil composition with excellent viscosity temperature characteristics and low temperature viscosity characteristics.

The alcohol constituting the ester-based base oil that is Component (B) may be a monohydric or polyhydric alcohol. The acid constituting the ester-based base oil may be a monobasic or polybasic acid. The ester-based base oil may be a complex ester compound as long as it has an ester bond. Preferred are monoesters and diesters, and more preferred are monoesters.

The monohydric alcohols may be those having usually 1 to 24 carbon atoms, preferably 1 to 12 carbon atoms, more preferably 1 to 8 carbon atoms. Such alcohols may be straight-chain or branched and saturated or unsaturated. Specific examples of alcohols having 1 to 24 carbon atoms include methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures thereof.

The polyhydric alcohols may be those of usually dihydric to decahydric, preferably dihydric to hexahydric. Specific examples of the polyhydric alcohols of dihydric to decahydric include dihydric alcohols such as ethylene glycol, diethylene glycol, polyethylene glycol (trimer to pentadecamer of ethylene glycol), propylene glycol, dipropylene glycol, polypropylene glycol (trimer to pentadecamer of propylene glycol), 1,3-propanedioil, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol, and neopentyl glycol; polyhydric alcohols such as glycerin, polyglycerin (dimer to octamer thereof, such as diglycerin, triglycerin, and tetraglycerin), trimethylolalkanes (trimethylolethane, trimethylolpropane, trimethylolbutane) and dimers to octamers thereof, pentaerythritol and dimers to tetramers thereof, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, and mannitol; saccharide such as xylose, arabinose, ribose, rhamnose, glucose, fructose, galactose, mannose, sorbose, cellobiose, maltose, isomaltose, trehalose, and sucrose; and mixtures thereof.

Among these polyhydric alcohols, preferable examples include those of dihydric to hexahydric, such as ethylene glycol, diethylene glycol, polyethylene glycol (trimer to decamer of ethylene glycol), propylene glycol, dipropylene glycol, polypropylene glycol (trimer to decamer of propylene glycol), 1,3-propanedioil, 2-methyl-1,2-propanediol, 2-methyl-1,3-propanediol, neopentyl glycol, glycerin, diglycerin, triglycerin, trimethylolalkanes (trimethylolethane, trimethylolpropane, trimethylolbutane) and dimers to tetramers thereof, pentaerythritol, dipentaerythritol, 1,2,4-butanetriol, 1,3,5-pentanetriol, 1,2,6-hexanetriol, 1,2,3,4-butanetetrol, sorbitol, sorbitan, sorbitol-glycerin condensate, adonitol, arabitol, xylitol, and mannitol, and mixtures thereof. More preferable examples include ethylene glycol, propylene glycol, neopentyl glycol, glycerin, trimethylolethane, trimethylolpropane, pentaerythritol, and sorbitan, and mixtures thereof. Most preferable examples include neopentyl glycol, trimethylolethane, trimethylolpropane and pentaerythritol, and mixtures thereof with the objective of attaining more excellent thermal/oxidation stability.

Among the acids constituting the ester used in the present invention, examples of monobasic acids include fatty acids having usually 2 to 24, which may be straight-chain or branched and saturated or unsaturated. Specific examples include saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanonic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic acid, and straight-chain or branched tetracosanoic acid; unsaturated fatty acids such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched nonadecenoic acid, straight-chain or branched eicosenic acid, straight-chain or branched heneicosenic acid, straight-chain or branched docosenic acid, straight-chain or branched tircosenic acid, and straight-chain or branched tetracosenic acid; and mixtures thereof. Among these fatty acids, with the objective of further enhancing lubricity and treatability, preferred are saturated fatty acids having 3 to 20 carbon atoms, unsaturated fatty acids having 3 to 22 carbon atoms, and mixtures thereof. More preferred are saturated fatty acids having 4 to 18 carbon atoms, unsaturated fatty acids having 4 to 18 carbon atoms, and mixtures thereof. In view of oxidation stability, most preferred are saturated fatty acids having 4 to 18 carbon atoms.

Examples of polybasic acids include dibasic acids having 2 to 16 carbon atoms and trimellitic acid. The dibasic acids having 2 to 16 carbon atoms may be straight-chain or branched, or saturated or unsaturated. Specific examples include ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecandioic acid, straight-chain or branched tridecanedioic acid, straight-chain or branched tetradecanedioic acid, straight-chain or branched heptadecanedioic acid, and straight-chain or branched hexadecanedioic acid, straight-chain or branched straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecenedioic acid, straight-chain or branched tetradecenedioic acid, straight-chain or branched heptadecenedioic acid, straight-chain or branched hexadecenedioic acid, and mixtures thereof.

No particular limitation is imposed on the combination of an alcohol and an acid, forming the ester. Examples of esters that can be used in the present invention include the following esters which may be used alone or in combination:

(a) an ester of a monohydric alcohol and a monobasic acid;
(b) an ester of a polyhydric alcohol and a monobasic acid;
(c) an ester of a monohydric alcohol and a polybasic acid;
(d) an ester of a polyhydric alcohol and a polybasic acid;
(e) a mixed ester of a mixture of a monohydric alcohol and a polyhydric alcohol and a polybasic acid;
(f) a mixed ester of a polyhydric alcohol, and a mixture of a monobasic acid and a polybasic acid; and
(g) a mixed ester of a mixture of a monohydric alcohol and a polyhydric alcohol, and a monobasic acid and a polybasic acid.

Among these esters, preferred are (a) an ester of a monohydric alcohol and a monobasic acid, (b) an ester of a polyhydric alcohol and a monobasic acid, and (c) an ester of a monohydric alcohol and a polybasic acid because of their excellent anti-fatigue properties for metals. More preferred are an ester of a monohydric alcohol and a monobasic acid and an ester of a monohydric alcohol and a dibasic acid.

In the present invention, when the ester is produced using a polyhydric alcohol as the alcohol component, the resulting ester may be a full ester all of which hydroxyl groups have been esterified, or a partial ester part of which hydroxyl groups remain unesterified. In the case of using a polybasic acid as the acid component, the resulting organic acid ester may be a full ester all of which carboxyl groups have been esterified, or a partial ester part of which carboxyl groups remain unesterified.

The ester-based base oil that is Component (B) used in the present invention may comprise only one type of or a mixture of two or more types of the above-exemplified ester compounds.

No particular limitation is imposed on the viscosity index of the ester-based base oil, which is, however, preferably 170 or greater, more preferably 180 or greater, more preferably 190 or greater. No particular limitation is imposed on the upper limit of the viscosity index, either. With the objective of enhancing stability when mixed with Component (A) and storage stability, the upper limit is preferably 300 or less, more preferably 250 or less, more preferably 230 or less, particularly preferably 210 or less.

No particular limitation is imposed on the density of Component (B). However, the density is preferably 0.80 g/cm$^3$ or greater, more preferably 0.82 g/cm$^3$ or greater, more preferably 0.84 g/cm$^3$ or greater, more preferably 0.85 g/cm$^3$ or greater, particularly preferably 0.86 g/cm$^3$ or greater, most preferably 0.87 g/cm$^3$ or greater. No particular limitation is imposed on the upper limit of the density. As one of the embodiments of the present invention, the density may be 1.0 g/cm$^3$ or greater. However, the upper limit is preferably 1.0 g/cm$^3$ or less, more preferably 0.95 g/cm$^3$ or less, more preferably 0.92 g/cm$^3$ or less, particularly preferably 0.90 g/cm$^3$ or less in view of excellent solubility with Component (A). The use of Component (B) with a density of 0.80 g/cm$^3$ or greater renders it possible to produce a lubricating oil composition that can achieve all viscosity temperature characteristics and low temperature performance, and anti-wear properties and anti-fatigue properties at higher levels. When the density of Component (B) is less than 0.80 g/cm$^3$, the resulting lubricating oil composition would be poor in anti-fatigue properties for metals and load bearing properties due to its insufficient oil film formation at lubricating sites.

No particular limitation is imposed on the upper limit of acid number of Component (B). However, the upper limit is preferably 5 mgKOH or less, more preferably 3 mgKOH or less, more preferably 2 mgKOH or less, particularly preferably 1.5 mgKOH or less, most preferably 1.0 mgKOH or less. As one of the embodiments of the present invention, the acid number may be 0.2 mgKOH or less. However, the acid number is preferably 0.2 mgKOH or greater, more preferably 0.5 mgKOH or greater. The use of Component (B) with an acid number of 5 mgKOH or less renders it possible to produce a lubricating oil composition with excellent oxidation stability.

The content of Component (B) in the lubricating oil composition of the present invention is necessarily 80 percent by mass or less, preferably 30 percent by mass or less, more preferably 20 percent by mass or less, more preferably 15 percent by mass or less, particularly preferably 13 percent by mass or less, most preferably 11 percent by mass or less, on the basis of the mixed base oil of Components (A) and (B). The lower limit content is necessarily 0.5 percent by mass or more, preferably 1 percent by mass or more, more preferably 2 percent by mass or more, more preferably 4 percent by mass or more, particularly preferably 7 percent by mass or more. The lubricating oil composition containing Component (B) in an amount of 80 percent by mass or less can be improved in oxidation stability. A larger content of Component (B) can improve the fuel efficiency and anti-fatigue properties for metals of the resulting lubricating oil composition. When the content in Component (B) is less than 0.5 percent by mass, the resulting lubricating oil composition may not attain required viscosity temperature characteristics, low temperature viscosity characteristics or anti-fatigue properties.

As long as the lubricating oil composition of the present invention contains Components (A) and (B) as main components, it may contain in addition thereto a mineral base oil and/or a synthetic base oil (excluding Components (A) and (B)), which are used in conventional lubricating oils. In this case, the total content of Components (A) and (B) is preferably from 50 to 99 percent by mass, more preferably from 70 to 97 percent by mass, more preferably from 85 to 95 percent by mass.

The mineral base oils may be a mineral based oil other than Component (A).

Specific examples of the synthetic base oil include polybutenes and hydrogenated compounds thereof; poly-α-olefins such as 1-octene oligomer and 1-decene oligomer, and hydrogenated compounds thereof; aromatic synthetic oils such as alkylnaphthalenes and alkylbenzenes; and mixtures thereof.

The mineral base oil and/or the synthetic base oil may be one type of or a mixture of two or more types selected from the above-mentioned oils. For example, the base oil used in the present invention may be one or more of the mineral base oils or synthetic base oils or a mixed oil of one or more of the mineral base oils and one or more of the synthetic base oils.

The lubricating base oil used in the present invention is a mixed base oil of Components (A) and (B) or such a mixed oil further containing the above-mentioned mineral base oil and/or synthetic base oil. The 40° C. kinematic viscosity of the mixed base oil of Components (A) and (B) is necessarily 18 mm$^2$/s or less, preferably 16 mm$^2$/s or less, more preferably 14 mm$^2$/s or less, particularly preferably 12 mm$^2$/s or less, most preferably 10 mm$^2$/s or less. The 40° C. kinematic viscosity of the mixed base oil is preferably 3 mm$^2$/s or greater, more preferably 5 mm$^2$/s or greater, more preferably 7 mm$^2$/s or greater, particularly preferably 8 mm$^2$/s or greater.

The 40° C. kinematic viscosity is also necessarily 18 mm$^2$/s or less even if the base oil is a mixed base oil of Components (A) and (B) further containing the above-mentioned mineral base oil and/or synthetic base oil.

No particular limitation is imposed on the 100° C. kinematic viscosity of the mixed base oil of Components (A) and (B). However, the 100° C. kinematic viscosity is preferably 3.5 mm$^2$/s or less, more preferably 3.2 mm$^2$/s or less, more preferably 3.0 mm$^2$/s or less, particular preferably 2.9 mm$^2$/s or less, most preferably 2.8 mm$^2$/s or less. The 100° C. kinematic viscosity is also preferably 1 mm$^2$/s or greater, more preferably 2 mm$^2$/s or greater, more preferably 2.3 mm$^2$/s or greater, particularly preferably 2.5 mm$^2$/s or greater. The viscosity index of the mixed base oil is preferably 100 or greater, more preferably 105 or greater, more preferably 110 or greater, particularly preferably 115 or greater, most preferably 120 or greater.

The lubricating oil composition of the present invention preferably contains a viscosity index improver as Component (C). Examples of the viscosity index improver include non-dispersant type viscosity index improvers such as (co)polymers of one or more monomers selected from various methacrylic acid esters and dispersant type viscosity index improvers such as copolymers of monomers further containing nitrogen compounds, i.e., polar monomers. Specific examples of other viscosity index improvers include non-dispersant- or dispersant-type ethylene-α-olefin copolymers of which α-olefin may be propylene, 1-butene, or 1-pentene, or hydrogenated compounds thereof; polyisobutylenes or hydrogenated compounds thereof; styrene-diene hydrogenated copolymers; styrene-maleic anhydride ester copolymers; and polyalkylstyrenes. The lubricating oil composition of the present invention may contain one or more compounds arbitrarily selected from these viscosity index improvers in any amount. However, the lubricating oil composition contains preferably a non-dispersant or dispersant type polymethacrylate, particularly preferably a non-dispersant type polymethacrylate because they can further enhance the low temperature characteristics and anti-fatigue properties of the lubricating oil composition.

No particular limitation is imposed on the weight average molecular weight (Mw) of Component (C), which is, however, preferably 70,000 or less, more preferably 50,000 or less, more preferably 40,000 or less, particularly preferably 30,000 or less. No particular limitation is imposed on the lower limit, which is usually 1,000 or greater, but preferably 10,000 or greater, more preferably 15,000 or greater, more preferably 20,000 or greater in view of excellent viscosity temperature characteristics and low temperature performance. When the weight average molecular weight (Mw) of Component (C) is less than 1,000, the resulting lubricating oil composition can not be improved sufficiently in viscosity temperature characteristics, i.e., fuel efficiency. When the weight average molecular weight (Mw) of Component (C) is greater than 70,000, the resulting lubricating oil composition would be poor in shear stability.

The content of Component (C) in the lubricating oil composition of the present invention is preferably from 0.01 to 20 percent by mass, more preferably from 5 to 15 percent by mass, resulting in enhancements in the viscosity index of the composition and sufficiently in the low temperature viscosity characteristics and anti-fatigue properties thereof.

If necessary, the lubricating oil composition of the present invention may contain various additives to an extent that they do not impair the excellent viscosity temperature characteristics and low temperature performance, and anti-fatigue properties and load bearing properties of the composition. No particular limitation is imposed on such additives. Any additives traditionally used in the field of lubricating oil may be blended. Specific examples of such additives include metallic detergents, ashless dispersants, anti-oxidants, extreme pressure additives, anti-wear agents, friction modifiers, pour point depressants, corrosion inhibitors, rust inhibitors, demulsifiers, metal deactivators, and anti-foaming agents. These additives may be used alone or in combination.

Examples of metallic detergents include sulfonate, salicylate and phenate detergents, which may be normal salts, basic salts and overbased salts with alkali metals or alkaline earth metals. Any one or more of these metallic detergents may be blended.

The ashless dispersant may be any ashless dispersant that has been used in lubricating oil. Examples of the ashless dispersant include mono or bis succinimides having in their molecules at least one straight-chain or branched alkyl or alkenyl group having 40 to 400 carbon atoms, benzylamines having in their molecules at least one alkyl or alkenyl group having 40 to 400 carbon atoms, polyamines having in their molecules at least one alkyl or alkenyl group having 40 to 400 carbon atoms, and boron-, carboxylic acid-, and phosphoric acid-modified products thereof. Any one or more of these ashless dispersants may be blended.

Examples of anti-oxidants include ashless anti-oxidants such as phenolic or aminic anti-oxidants and metallic anti-oxidants such as copper or molybdenum anti-oxidants.

Examples of friction modifiers include ashless friction modifiers such as fatty acid esters, aliphatic amines, and fatty acid amides, and metallic friction modifiers such as molybdenum dithiocarbamates and molybdenum dithiophosphates.

Extreme pressure additives and anti-wear agents may be any of those used in lubricating oil. The extreme pressure additive may be any of sulfuric, phosphoric and sulfuric-phosphoric extreme pressure additives. Specific examples include phosphorus acid esters, thiophosphorus acid esters, dithiophosphorus acid esters, trithiophosphorus acid esters, phosphoric acid esters, thiophosphoric acid esters, dithiophosphoric acid esters, trithiophosphoric acid esters, amine salts, metal salts or derivatives thereof, dithiocarbamates, zinc dithiocaramates, molybdenum dithiocarbamates, disulfides, polysulfides, sulfurized olefins, and sulfurized fats and oils.

Examples of pour point depressants include polymethacrylate polymers conforming with a lubricating base oil to be used.

Examples of corrosion inhibitors include benzotriazole-, tolyltriazole-, thiadiazole-, and imidazole-type compounds.

Examples of rust inhibitors include petroleum sulfonates, alkylbenzene sulfonates, dinonylnaphthalene sulfonates, alkenyl succinic acid esters, and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal deactivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of the anti-foaming agents include silicone oil with a 25° C. kinematic viscosity of from 0.1 to 100 $mm^2/s$, alkenylsuccinic acid derivatives, esters of polyhydroxy aliphatic alcohols and long-chain fatty acids, aromatic amine salts of methylsalicylate and o-hydroxybenzyl alcohol.

When these additives are contained in the lubricating oil composition of the present invention, the content of each of the additives is preferably from 0.1 to 20 percent by mass on the basis of the total mass of the composition.

The 40° C. kinematic viscosity of the lubricating oil composition of the present invention is necessarily from 4 to 23 $mm^2/s$. The upper limit is preferably 22 $mm^2/s$, more preferably 21.5 $mm^2/s$, more preferably 21.0 $mm^2/s$, particularly preferably 20.5 $mm^2/s$, most preferably 20 $mm^2/s$. The lower limit is preferably 5 $mm^2/s$, more preferably 15 $mm^2/s$, more preferably 17 $mm^2/s$, particularly preferably 18 $mm^2/s$, most preferably 19 $mm^2/s$. When the kinematic viscosity at 40° C. is less than 5 $mm^2/s$, the composition would have problems regarding oil film retainability at lubricating sites and evaporation. When the 40° C. kinematic viscosity is greater than 23 $mm^2/s$, the composition would be poor in fuel efficiency.

No particular limitation is imposed on the 100° C. kinematic viscosity of the lubricating oil composition of the present invention. However, the upper limit is preferably 6.0 $mm^2/s$, more preferably 5.5 $mm^2/s$, more preferably 5.3 $mm^2/s$, particularly preferably 5.2 $mm^2/s$, most preferably 5.1 $mm^2/s$. The lower limit is preferably 1.5 $mm^2/s$, more preferably 4.0 $mm^2/s$, more preferably 4.5 $mm^2/s$, particularly preferably 4.8 $mm^2/s$, most preferably 5.0 $mm^2/s$. When the 100° C. kinematic viscosity is less than 1.5 $mm^2/s$, the composition would have problems regarding oil film retainability at lubricating sites and evaporation. When the 100° C. kinematic viscosity is greater than 6.0 $mm^2/s$, the composition would be poor in fuel efficiency.

No particular limitation is imposed on the viscosity index of the lubricating oil composition of the present invention, which is, however, preferably 160 or greater, more preferably 180 or greater, more preferably 190 or greater, particularly preferably 195 or greater.

The −40° C. Brookfield (BF) viscosity of the lubricating oil composition of the present invention is preferably 150000 Pa·s or less, more preferably 10000 Pa·s or less, more preferably 8000 Pa·s or less, particularly preferably 6000 Pa·s or less, most preferably 5500 Pa·s or less.

The Brookfield viscosity referred herein denotes a value measured in accordance with ASTM D2983.

APPLICABILITY IN THE INDUSTRY

The lubricating oil composition of the present invention is a lubricating oil composition that is excellent not only in anti-wear properties and anti-fatigue properties but also in low temperature fluidity and thus is particularly suitable as an automatic transmission oil and/or a continuously variable transmission oil.

The lubricating oil composition of the present invention is excellent in other performances as a transmission oil than those described above and thus is suitably used as a lubricating oil for the manual transmissions and differential gears of automobiles, construction machinery, and agricultural machinery. Other than these usages, the lubricating oil composition may be suitably used as a lubricating oil required to have anti-wear properties, anti-fatigue properties, and low temperature viscosity characteristics, such as a gear oil for industrial use, a lubricating oil for the gasoline engines, diesel engines, and gas engines of automobiles such as two- and four-wheeled vehicles, power generators, and ships, a turbine oil, and a compressor oil.

EXAMPLES

Hereinafter, the present invention will be described in more details by way of the following examples and comparative examples, which should not be construed as limiting the scope of the invention.

Examples 1 to 4 and Comparative Examples 1 to 3

As set forth in Table 1 below, lubricating oil compositions according to the present invention (Examples 1 to 4) and those for comparison (Comparative Examples 1 to 3) were prepared. The kinematic viscosities, low temperature viscosity characteristics, anti-fatigue properties, and load bearing properties by four-ball test of each of the resulting compositions were measured, and the results are also set forth in Table 1.

The details of the base oils in Table 1 are as follows.

Base oil A-1: mineral oil [100° C. kinematic viscosity: 2.6 $mm^2/s$, 40° C. kinematic viscosity: 9.5 $mm^2/s$, viscosity index: 111, aniline point: 104° C., % $C_P$: 75, % $C_A$: 1, pour point: −27.5° C., S content: 1 ppm by mass or less, N content: 3 ppm by mass or less]

Base oil A-2: mineral oil [100° C. kinematic viscosity: 4.1 $mm^2/s$, 40° C. kinematic viscosity: 18.7 $mm^2/s$, viscosity index: 120, aniline point: 112° C., % $C_P$: 78, % $C_A$: 1, pour point: −22.5° C., S content: 2 ppm by mass, N content: 3 ppm by mass or less]

Base oil A-3: mineral oil [100° C. kinematic viscosity: 4.4 $mm^2/s$, 40° C. kinematic viscosity: 22.8 $mm^2/s$, viscosity index: 102, aniline point: 99° C., % $C_P$: 66, % $C_A$: 6, pour point: −15.0° C., S content: 1300 ppm by mass, N content: 6 ppm by mass]

Base oil A-4: mineral oil [100° C. kinematic viscosity: 2.0 $mm^2/s$, 40° C. kinematic viscosity: 6.6 $mm^2/s$, viscosity index: 93, aniline point: 87° C., % $C_P$: 61, % $C_A$: 5.3, pour point: −25.0° C., S content: 1000 ppm by mass, N content: 3 ppm by mass or less]

Ester-based base oil B-1: monoester (monoester of C8 alcohol and fatty acid) [density: 0.87 $g/cm^3$, 100° C. kinematic viscosity: 2.68 $mm^2/s$, 40° C. kinematic viscosity: 8.2 $mm^2/s$, 0° C. kinematic viscosity: 30.8 $mm^2/s$, viscosity index: 182, pour point: −40° C., acid number: 1.0 mgKOH]

Ester-based base oil B-2: polyolester (neopentyl glycol diester) [density: 0.90 $g/cm^3$, 100° C. kinematic viscosity: 5.9 $mm^2/s$, 40° C. kinematic viscosity: 24.0 $mm^2/s$, 0° C. kinematic viscosity: 127 $mm^2/s$, viscosity index: 206, pour point: −30° C., acid number: 1.0 mgKOH]

Viscosity index improver C-1: weight average molecular weight: 25,000, non-dispersant type polymethacrylate Viscosity index improver C-2: weight average molecular weight: 20,000, non-dispersant type polymethacrylate Performance additive D-1: additive package for transmissions containing an anti-wear agent, a friction modifier, an anti-oxidant and the like (1) Low Temperature Viscosity Characteristics The −40° C. BF viscosity of each of the compositions was measured in accordance with ASTM D2983. In this test, the lower BF viscosity the composition has, it is more excellent in low temperature fluidity.

(2) Anti-Fatigue Properties

The fatigue life up to pitting was evaluated for each composition under the following conditions using a high temperature rolling-contact fatigue test machine. The ratio of the fatigue life up to pitting of each composition was calculated on the basis of the result of Comparative Example 1. In this test, a longer fatigue life ratio (L50 ratio and L10 ratio) indicates that the composition is more excellent in anti-fatigue properties.

Thrust needle bearing (surface pressure: 1.9 GPa, rotating speed: 1410 rpm, oil temperature: 120° C.)

(3) High-Speed Four-Ball Load Bearing Properties

The last non-seizure load (LNSL) of each of the compositions at a rotating speed of 1800 rpm was measured using a high-speed four-ball tester in accordance with ASTM D 2596. In this test, a larger last non-seizure load indicates that the composition is more excellent in load bearing properties.

(4) Oxidation Stability

The acid number increase and content of matters insoluble in pentane of each of the compositions were measured in accordance with JIS K 2514 4 (Oxidation stability test for internal combustion engine oil).

As apparent from the results set forth in Table 1, it is confirmed that the lubricating oil compositions of Examples 1 to 4 according to the present invention were excellent in viscosity temperature characteristics, low temperature characteristics, anti-fatigue properties and load bearing properties.

Whereas, the composition of Comparative Example 1 containing no Component (B) and having a 40° C. kinematic viscosity deviating the claimed range was poor in viscosity temperature characteristics, low temperature viscosity characteristics and anti-fatigue properties. Likely, the composition of Comparative Example 2 containing no Component (B) was also poor in anti-fatigue properties and load bearing properties and insufficient in low temperature viscosity characteristics. The composition of Comparative Example 3 containing no Component (A) was poor in anti-fatigue properties, load bearing properties and low temperature viscosity characteristics.

TABLE 1

| | | | Example 1 | Example 2 | Example 3 | Example 4 | Comparative Example 1 | Comparative Example 2 | Comparative Example 3 |
|---|---|---|---|---|---|---|---|---|---|
| Base Oil composition (on the basis of total mass of base oil) | | | | | | | | | |
| Base Oil A-1 | | mass % | 80 | 82 | 87 | 80 | 30 | 70 | |
| Base Oil A-2 | | mass % | | 8 | 8 | | 60 | | |
| Base Oil A-3 | | mass % | | | | | 10 | | |
| Base Oil A-4 | | mass % | | | | | | 30 | |
| Base Oil B-1 | | mass % | 17 | 10 | 5 | | | | 61 |
| Base Oil B-2 | | mass % | 3 | | | 20 | | | 39 |
| Ester-based base Oil | | mass % | 20 | 10 | 5 | 20 | — | — | 100 |
| Kinematic viscosity of Component (A) | 40° C. | $mm^2/s$ | 9.5 | 10.0 | 10.0 | 9.5 | 15.3 | 8.5 | — |
| Kinematic viscosity of Component (B) | 40° C. | $mm^2/s$ | 9.4 | 8.2 | 8.2 | 24.0 | — | — | 11.9 |
| | 0° C. | $mm^2/s$ | 37.0 | 30.8 | 30.8 | 127 | — | — | 48.6 |
| Kinematic viscosity of mixed base Oil | 40° C. | $mm^2/s$ | 9.4 | 9.7 | 9.8 | 11.1 | 15.3 | 8.5 | 11.9 |
| | 100° C. | | 2.7 | 2.7 | 2.7 | 3.0 | 3.6 | 2.5 | 3.6 |
| Additive composition (on the basis of total mass of composition) | | | | | | | | | |
| Viscosity index improver C-1 | | mass % | | | | | 6 | | |
| Viscosity index improver C-2 | | mass % | 11 | 11 | 11 | 7 | | 14 | 3 |
| Performance additive D-1 | | mass % | 12 | 12 | 12 | 12 | 12 | 12 | 12 |
| Kinematic viscosity of composition | 40° C. | $mm^2/s$ | 19.5 | 19.8 | 19.9 | 20.0 | 25.9 | 20.1 | 18.7 |
| | 100° C. | $mm^2/s$ | 5.02 | 5.03 | 5.02 | 5.04 | 5.66 | 5.01 | 5.01 |
| | VI | | 203 | 199 | 196 | 197 | 171 | 191 | 217 |
| BF viscosity | −40° C. | mPa · s | 5180 | 4630 | 4470 | 6300 | 12000 | 6900 | 7000 |
| Fatigue life | L10 | % | 1.4 | 1.5 | 1.3 | 1.2 | 1.0 | 0.6 | 1.2 |
| | L50 | % | 1.2 | 1.3 | 1.3 | 1.1 | 1.0 | 0.7 | 1.1 |
| Four-ball extreme pressure test | LNSL | N | 618 | 618 | 618 | 618 | 618 | 490 | 490 |
| Oxidation stability | | | | | | | | | |
| (ISOT: 165° C., 144 h) | Acid number increase | mg · KOH/g | 3.23 | 2.59 | 1.97 | 4.54 | 1.67 | 1.83 | 18.9 |
| pentane insoluble | B method | mass % | 0.03 | 0.02 | 0.00 | 0.10 | 0.00 | 0.00 | 9.01 |

The invention claimed is:

1. A lubricating oil composition comprising:

(A) one type or a mixture of two or more types of mineral base oil having a 40° C. kinematic viscosity of from 5 to 15 $mm^2/s$; and (B) one type or a mixture of two or more types of ester-based base oil having a 40° C. kinematic viscosity of from 3 to 25 $mm^2/s$, a 0° C. kinematic viscosity of from 10 to 130 $mm^2/s$ and a viscosity index of 170 or greater, the 40° C. kinematic viscosity of the mixed base oil of (A) and (B) being 18 $mm^2/s$ or lower, the blend ratio of the ester-based base oil being from 0.58 to 80 percent by mass, and the 40° C. kinematic viscosity of the composition being from 4 to 23 $mm^2/s$.

2. A lubricating oil composition comprising:

(A) one type or a mixture of two or more types of mineral base oil having a 40° C. kinematic viscosity of from 5 to 15 $mm^2/s$;

(B) one type or a mixture of two or more types of ester-based base oil having a 40° C. kinematic viscosity of from 3 to 25 $mm^2/s$ and a 0° C. kinematic viscosity of from 10 to 130 $mm^2/s$, the 40° C. kinematic viscosity of the mixed base oil of (A) and (B) being 18 $mm^2/s$ or lower, the blend ratio of the ester-based base oil being from 0.58 to 80 percent by mass, and the 40° C. kinematic viscosity of the composition being from 4 to 23 $mm^2/s$; and (C) a polymethacrylate viscosity index improver with a weight-average molecular weight of 70,000 or less.

3. The lubricating oil composition according to claim 1, wherein the ester-based base oil (B) is a monoester.

4. The lubricating oil composition according to claim 2, wherein the ester-based base oil (B) is a monoester.

5. The lubricating oil composition according to claim 1, further comprising (C) a polymethacrylate viscosity index improver with a weight-average molecular weight of 70,000 or less.

6. A transmission oil comprising a lubricating oil composition according to claim 1.

7. A transmission oil comprising a lubricating oil composition according to claim 2.

* * * * *